US005638909A

United States Patent [19]

Henderson

[11] Patent Number: 5,638,909

[45] Date of Patent: Jun. 17, 1997

[54] BOLT REMOVAL DEVICE AND METHOD FOR AN AIR HAMMER

[76] Inventor: Lawrence Henderson, 101 Henderson Dr., Clemson, S.C. 29631

[21] Appl. No.: 307,079

[22] Filed: Sep. 16, 1994

[51] Int. Cl.[6] ..... B25D 9/04; B25D 17/00

[52] U.S. Cl. ..... 173/211; 29/252; 227/147

[58] Field of Search ..... 173/211, 171; 227/147, 156, 140; 29/252; 81/451

[56] References Cited

U.S. PATENT DOCUMENTS

| | | | |
|---|---|---|---|
| 1,213,970 | 1/1917 | Sturtevant . | |
| 2,272,760 | 2/1942 | Allen | 1/46.1 |
| 2,356,314 | 8/1944 | Gray et al. | 173/211 X |
| 2,671,216 | 3/1954 | Fox | 227/147 |
| 2,890,455 | 6/1959 | Etzkorn | 1/49.9 |
| 3,219,248 | 11/1965 | Krewson, Jr. | 227/147 X |
| 4,646,852 | 3/1987 | Cotta | 173/128 |
| 5,450,911 | 9/1995 | Gustafsson | 173/211 X |

*Primary Examiner*—Joseph M. Gorski
*Attorney, Agent, or Firm*—Henry S. Jaudon; Cort Flint

[57] ABSTRACT

This invention relates to an attachment device for a pneumatic hammer tool used to remove a bolt or rod being held in a fixture. The low cost attachment device consists of an alignment sleeve and a tapered coil spring which aligns a driving bit of an air hammer to the bolt to be driven from the fixture and absorbs the shock of the impact during the driving operation. As the driving bit reaches the end of its travel, the addition of a spacer bar allows the driving operation to continue. A method for removal of the bolt is disclosed to facilitate the removal operation. This method relies on the contact of the alignment sleeve with the fixture and the compression of the spring to facilitate quick removal of the bolt. An application of this apparatus has been used to remove a spring attachment bolt on a truck trailer reducing the time for removal to 30 minutes from 3 to 4 hours.

5 Claims, 4 Drawing Sheets

10
20
24
A
25
30
2
2
46
42
22
27
40
P
44

BOLT REMOVAL DEVICE AND METHOD FOR AN AIR HAMMER

BACKGROUND OF THE INVENTION

This invention relates to a hand held tool and more particularly to an attachment to an air hammer for removing a bolt from a fixture.

The removal of a bolt or rod from a fixture holding the bolt or rod is a common task in maintaining vehicles such as large trucks, off-road vehicles and trailers, as well as construction, farming and mining equipment. This task is often very time consuming and keeps the vehicle or equipment from being more productive.

The removal of bolts or rods is often made more difficult by corrosion of the material and by the use of rubber bushings which grip the bolt or rod and keep it from being easily removed. This is particularly true for those components associated with the suspension systems of vehicles. For example, the assembly that attaches a leaf spring of a heavy truck or trailer axle to a shackle fixture on the frame of the truck or trailer often has a rubber grommet. This grommet grips the assembly to remove any possibility of a loose fit (non-compliant) spring attachment. Removal of the bolts securing this assembly is very difficult and due to corrosion and/or wear can take 3 to 4 hours to remove a single bolt using standard means.

The invention of the pneumatically activated hammer or drill tool has eliminated much of the physical effort in driving or impacting an object. However, even these tools have their limits as they are heavy and alignment with an object such as a bolt or rod to be driven is only partially achieved presenting a difficult problem. Also, shock loads from the driving energy is not properly absorbed. In U.S. Pat. No. 1,213,970 the spud end of a shank of a hammer drill fits into a hole in a socket such that a head of the shank engages the head of a spike. The socket guides the spud and slides up on two rods against the compression of two soft springs at the end of the driving operation. At the point of contact between the head of the driving spud and the fixture, the end of the spike approaches the forward end of the socket. Two additional stiff springs and two additional nuts maintain the two rods as well as the socket displaced from a tool holder on the drill hammer. This spike holder requires a number of spring and rod components and the socket does not contact the fixture receiving the spike until the end of the driving operation.

A similar device is disclosed in U.S. Pat. No. 2,272,760 where a sleeve is attached to the end of a driving device stem to loosely receive the head of a railroad spike. The guiding element sleeve is permanently attached to the end of a stem. A compression spring is positioned within an enlarged portion of the sleeve. As the head of the spike approaches the railroad tie the sleeve abuts the rail flange and compresses the spring. The sleeve does not abut the rail until the end of the driving operation.

A nail driver disclosed in U.S. Pat. No. 2,890,455 has a sleeve supported by two springs from a retaining member placed against a tool housing or collar of the pneumatic hammer. A housing spring has a spacing of the coils (pace) such that no compression can occur. The other spring fits inside the housing spring around a driving member and abuts the sleeve and the retaining member. The housing spring retains the stem portion or driving bit from falling out of the tool and the other spring allows the sleeve to be telescoped by compressing this inner spring. The housing spring cannot be stretched and substituted for the other spring due to the constant wear that would require replacement of the entire housing spring, as disclosed in the patent. Two springs, the retaining member and the sleeve are required with this nail driver, and no requirement to contact the fixture receiving the nail is disclosed.

According to U.S. Pat. No. 4,646,852 there is provided a hand tool in the form of a pneumatic activated mallet. A mallet head is reciprocally mounted in a housing and a spring biases the mallet head away from the driver. A push force on a nose piece on the mallet will compress the spring and allow the driver to contact the mallet head. This hand tool does not suggest a device to retain an article being driven.

The art does not solve the need for a low cost attachment that can be used as an alignment an shock absorbing device for removing a bolt or rod from a fixture.

Accordingly, an object of the invention is to provide a simple low cost attachment for an air hammer to be used to remove a bolt or rod from a fixture when the holding power of the fixture requires a relatively long driving distance;

Another object of the invention is to provide an alignment and shock absorbing attachment for an pneumatic power tool that will facilitate removal of a bolt or rod from a fixture;

A further object of the invention is to reduce the time it takes to remove a bolt being held by corrosion and/or wear that continuously holds the bolt during the entire removal process.

SUMMARY OF THE INVENTION

The above objectives are accomplished according to the present invention by providing an alignment and shock absorbing device for use with an air hammer having a driving bit to remove a bolt from a fixture. The present invention is based on a single tapered coil spring that connects the pneumatically operated tool to an alignment sleeve. The alignment sleeve abuts the fixture to hold and align the attachment to facilitate quick removal of the bolt or rod. The invention comprises an alignment sleeve having an outer wall forming an interior cylindrical bore that receives and aligns the bolt with the driving bit of the air hammer. The alignment sleeve has a first free end that abuts and is held in contact with the fixture during driving and removal of the bolt. The alignment sleeve has a second end remote from the first end of the alignment sleeve. The invention further comprises a tapered coil spring carried by the alignment sleeve having a first end fixed to the second end of the alignment sleeve. The coil spring has a second end which includes at least one coil for encircling an outer surface of a collar of the air hammer to attach the alignment sleeve and the air hammer. An interfacial space is created between the second end of the attached alignment sleeve and the collar when the coil spring is not compressed. The alignment sleeve and the coil spring become an alignment and shock absorbing attachment for the air hammer as the coil spring becomes compressed and the bolt is driven outwardly from the fixture.

The objects are also met by a second embodiment of the invention being an apparatus for aligning and driving a bolt from a fixture. The apparatus comprises an air hammer having a collar and a driving bit extending from the collar. This embodiment further comprises a tapered coil spring having a second end which includes at least one coil for encircling an outer surface of the collar of the air hammer to attach the coil spring to the air hammer. The coil spring also has a first end remote from the second end of the coil spring.

This embodiment further comprises an alignment sleeve carried by the first end of the coil spring. The alignment sleeve has an outer wall forming an interior cylindrical bore that receives and aligns the driving bit of the air hammer with the bolt. The alignment sleeve has a first free end that abuts and is placed and held in contact with the fixture during driving and removal of the bolt. The alignment sleeve has a second end attached to the first end of the coil spring to define an interfacial space between the second end of the alignment sleeve and the collar when the coil is not compressed. Therefore, the alignment sleeve, the coil spring and the air hammer become an apparatus for alignment with and driving of the bolt from the fixture as the coil spring becomes compressed and the air hammer is driving the bolt.

The objects of this invention are further met by another embodiment of this invention being a method for removing a bolt from a fixture using an air hammer having a collar and a driving bit extending from the collar. The method comprises a number of steps. A first step is providing an alignment sleeve having a cylindrical bore extending between a first end and a second end of the alignment sleeve, and a coil spring having a first end affixed to the second end of the alignment sleeve and a second end of the coil spring remote from the first end. A second step is attaching the second end of the coil spring to the collar on the air hammer so that at least one coil of the coil spring encircles an outer edge of the collar. An interfacial space is created between the second end of the alignment sleeve and the collar and an outer end of the driving bit of the air hammer is positioned within the cylindrical bore of the alignment sleeve. A third step is placing the second end of the alignment sleeve in an abutting relationship with the fixture such that the bolt is within said cylindrical bore and is further aligned with the driving bit of the air hammer. A fourth step is holding the air hammer with the alignment sleeve and the coil spring attachment such that the coil spring is partially compressed and the outer end of the driving bit of the air hammer is positioned at a driving interface at an outer end of the bolt. A final step is forcing the bolt to be displaced with respect to the fixture by energizing the air hammer and maintaining the alignment sleeve to abut the fixture while the bolt is being driven.

DESCRIPTION OF THE DRAWINGS

The construction designed to carry out the invention will hereinafter be described, together with other features thereof.

The invention will be more readily understood from a reading of the following specification and by reference to the accompanying drawings forming a part thereof, wherein an example of the invention is shown and wherein.

DESCRIPTION OF A PREFERRED EMBODIMENTS

Figure 6:
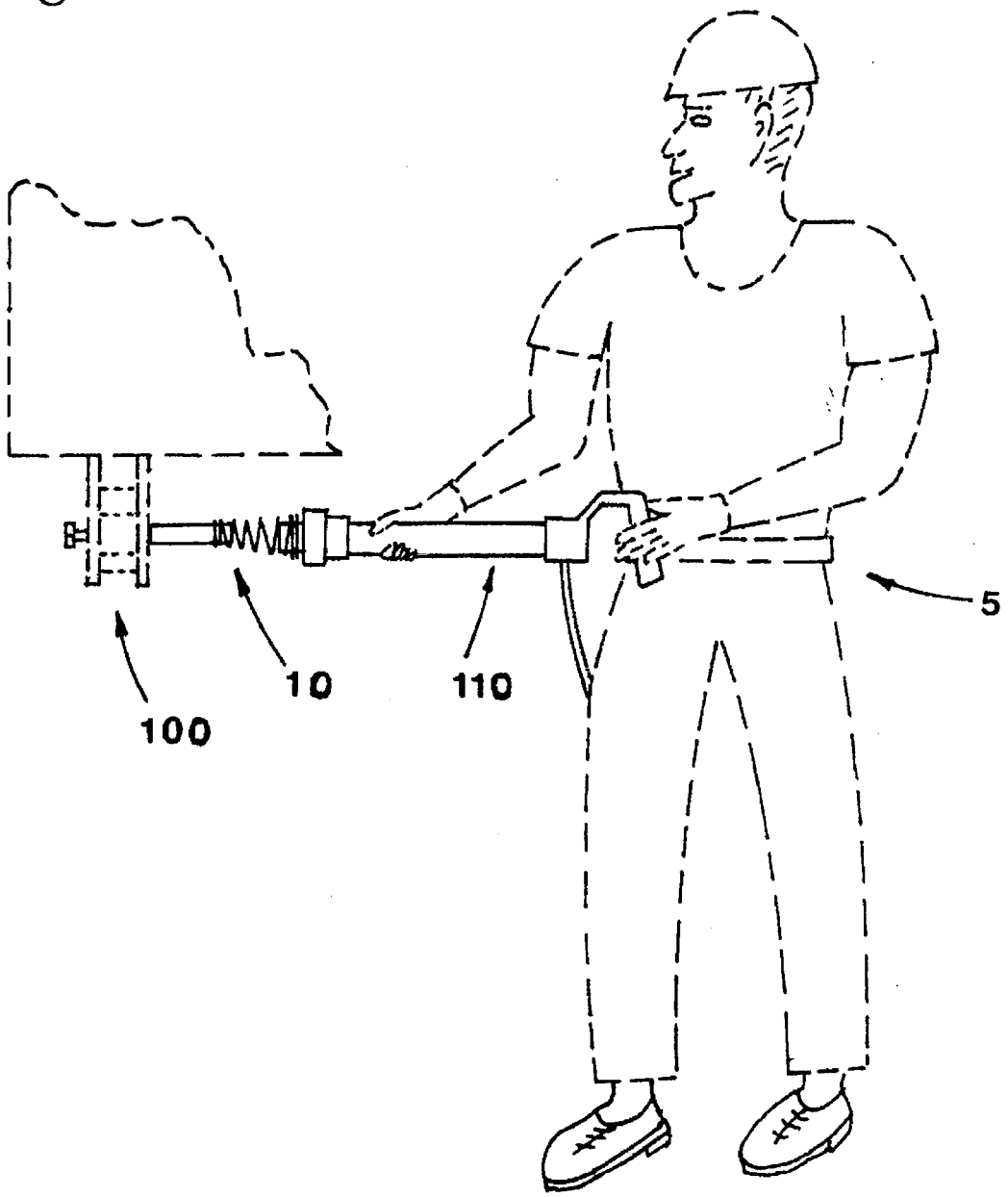
FIG. 6 is a elevation view of the air hammer with the apparatus of this invention being held by the user as it removes a bolt from a fixture.

Pneumatic hammer tools are well known in the art. The air hammer of this invention has a long cylindrical body with a handle at one end where an air hose is attached and a trigger to activate the air hammer is located. The hammer is held by both hands of the operator being one on the cylindrical body and the other on the handle (FIG. 6). During operation of the air hammer a driving bit is forced in and out of a collar at an opposite end of the cylindrical body to the handle. The extent of the movement of the driving bit is limited and controlled by the design of the air hammer. It is not within the scope of this invention to modify the design and operation of an air hammer. An air hammer typical of the type used in this invention is model number C9364 manufactured by Chicago Pneumatic Tool Company of Utica, N.Y. More details of the air hammer will become apparent as the illustrations are discussed in more detail.

Figure 1:
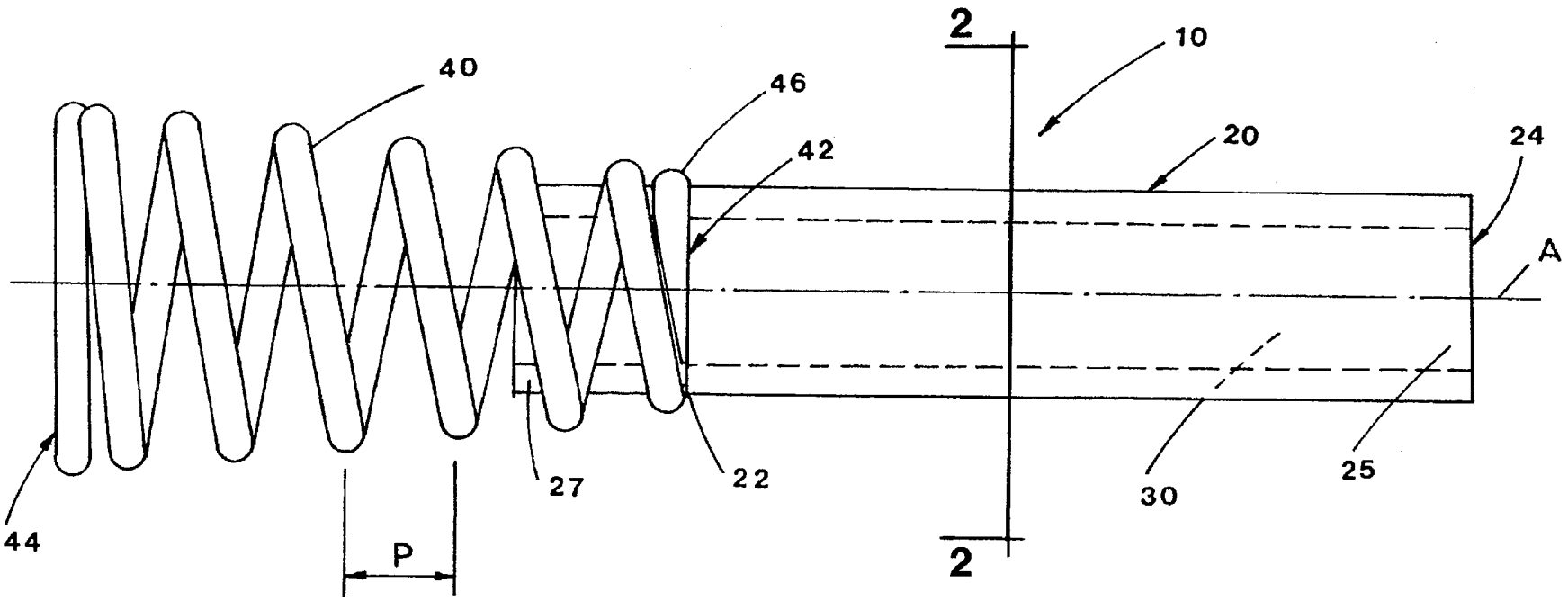
FIG. 1 is an elevation view of a tapered coil spring and an alignment sleeve attachment embodying the present invention.

The attachment device 10 for the air hammer is illustrated in FIG. 1. An alignment sleeve 20 has a outer wall 26 that forms a cylindrical bore 30. The alignment sleeve 20 has a first free end 25 with an a free end surface 24 being perpendicular to the centerline axis A of the alignment device. The alignment sleeve has a second end 27 remote from the first free end 25 where a tapered coil spring 40 is attached. The coil spring is attached by providing a locking groove 22 in the alignment sleeve 20 which encircles the outer surface of the alignment sleeve. The shape of the notch can be a rectangle or a circular shape to receive an end coil 46 of a first end 42 of the coil spring 40. The end coil 46 fits into the locking groove 22 and rigidly attaches the coil spring 40 to the alignment sleeve 20. The smallest diameter of the tapered coil spring is located at the first end 42 and the second end 44 is remote from the first end 42 where the largest diameter of the tapered coil spring is located. The attachment device 10 is symmetrical with respect to a driving axis AX of the device. The pace of the coil spring 40 is the axial distance P between adjacent coils and becomes a smaller value near both ends 42,44 of the coil spring. The alignment sleeve and the coil spring are preferably made of a steel material to be more resistant to wear during their use. Other materials can also be used within the scope of this invention. The coil spring is made of a spring steel common in the industry. Further details of the attachment device will become apparent as the other figures are disclosed.

Figure 2:
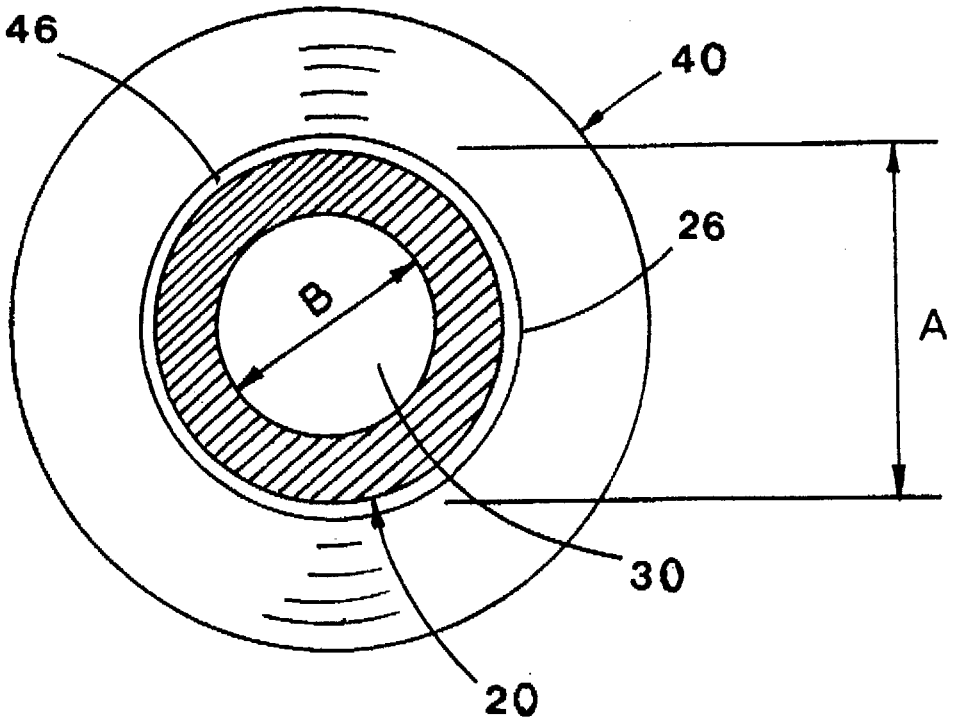
FIG. 2 is a cross sectional view of the attachment of this invention taken along line 2—2 in FIG. 1.

A cross-section of the attachment device taken along plane 2—2 in FIG. 1 is illustrated in FIG. 2. The outer wall 26 of the alignment sleeve 20 forms a cylindrical bore 30. The bore has a diameter B and a length being the entire axial length of the alignment sleeve 20. The outer diameter A of the outer wall 26 is larger than the interior diameter of the end coil 46 of the coil spring 40 so that the end coil is held by the locking groove 22 (FIG. 1).

Figure 3:
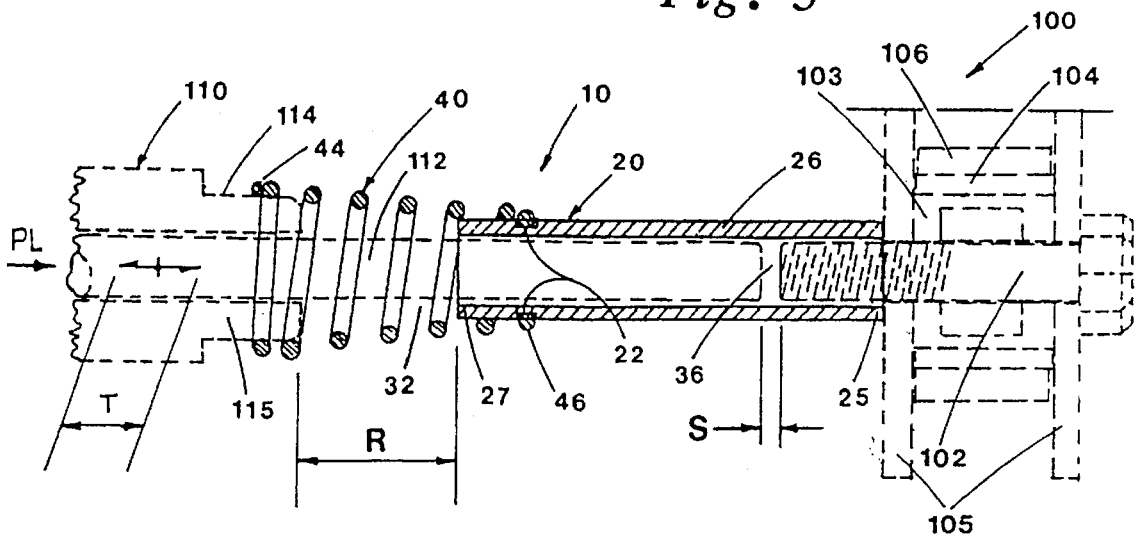
FIG. 3 is a cross sectional view of the attachment of FIG. 1 taken in a plane containing an axis of the attachment and being connected to a collar of an air hammer having a driving bit and positioned to remove a bolt from a fixture.

The attachment device mounted on an air hammer 110 is illustrated in FIG. 3. The air hammer has a collar 115 from which a driving bit 112 extends. The second end 44 of the coil spring 40 grips an outer surface 114 of the collar 115 and holds the attachment device fixed to the air hammer. The driving bit 112 extends through the coil spring along the driving axis AX and into the cylindrical bore 30 (FIG. 1) at the second end 27 of the alignment sleeve 20. The first end 25 of the alignment sleeve 20 is placed over an outer end of a bolt 102 to be removed. The bolt to be removed is being retained by a fixture 100. The fixture can have a cylindrical hub 103 and mounting brackets 105, as shown in FIG. 3, or similar objects that grip the bolt 102 and making it difficult to remove. Alternately, a plurality of bolts 102 may be used. Other fixture arrangements and holding devices that make removal of a bolt or rod difficult are within the scope of this invention. The alignment sleeve 20 has its first end 25 placed in contact with the fixture 100 to abut and stabilize the alignment device. An axial load PL is applied by the user to provide this abutting arrangement and to align the driving bit 112 with the bolt 102.

The alignment sleeve is configured such that the outer end of the driving bit 112 approaches the outer end of the bolt 102 as illustrated in FIG. 3. An interfacial space 32 is created between the end of the collar 115 and the second end 27 of the alignment sleeve. The coil spring is slightly compressed under the action of the axial load PL and there is a driving interface 36 where a small interface distance S exists. The interface distance S is much smaller than a driving travel length T of the driving bit 112 of the air hammer, to allow the bolt to be driven out of the fixture. As the air hammer is energized and driving continues, the axial load PL can be increased by the operator to further compress the coil spring 40 and increase the effective driving distance of the driving bit 112. The coil spring is selected to have a stiffness in the range of about 50 pounds per inch to about 100 pounds per inch. This stiffness should permit the coil spring to be compressed by approximately one inch by the user. To permit this compression the pace P of the adjacent coils in a central portion of the coil spring is preferably in a range of about 0.50 to about 0.75 inch. Other stiffness values, pace and compression distances can be realized to fit the ability of the user as well as the type of bolt 102 and distance it must be driven.

Figure 4:
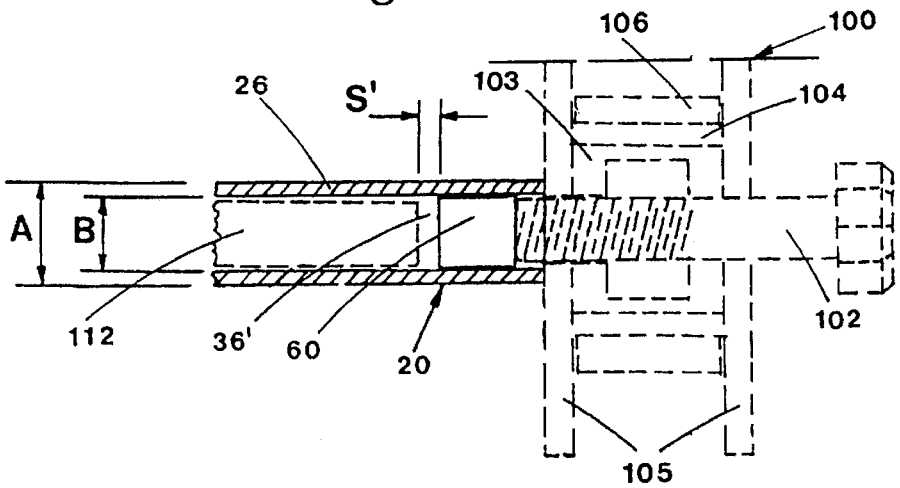
FIG. 4 is a cross sectional view of a portion of the alignment sleeve taken in the axial plane and showing a spacer rod of this invention between an outer end of the driving bit and the outer end of the bolt.
Figure 5:
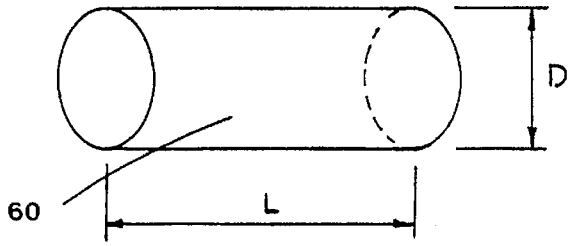
FIG. 5 is a perspective view of the spacer rod of this invention.

After the driving bit 112 has driven the bolt 102 as far as the physical limits of the air hammer 110 and the attachment device 10 will allow, the bolt 102 may not be removed from the fixture 100. A spacer rod 60 is added to the cylindrical bore of the alignment sleeve 20, as illustrated in FIG. 4, to extend the driving distance of the air hammer and attachment device apparatus. The spacer rod can be a simple cylindrical bar having a diameter D and a length L as illustrated in the perspective view of FIG. 5. The length of the spacer rod should be at least equal to the travel length T of the driving bit. The new interface distance S' at the new driving interface 36' should be similar to the initial interface distance S at the initial driving interface 36. Numerous spacer rods having various lengths which are whole integer multiples (N) of the travel length (or N×T) can be provided within the scope of this invention.

A relatively close fit of the spacer rod 60 in the cylindrical bore 30 is provided to assist in driving the bolt and to limit any damage to the alignment sleeve 20. The outside diameter D of the spacer rod is preferably about 0.05 inch less than the cylindrical bore diameter B. However, the outer diameter of the driving bit 112 should be such that the driving bit can move freely without damage to either the driving bit or the alignment sleeve and without lubrication. The diameter B of the cylindrical bore is preferably greater than the outer diameter D of the driving bit by at least 0.10 inch.

The air hammer with its attachment device is an apparatus to be hand held as illustrated in FIG. 6. The operator 5 holds the apparatus in both hands and aligns the air hammer 110 and the attachment device 10 with a bolt in the fixture 100. The bolt fit inside the alignment sleeve portion of the attachment device and is driven from the fixture. As the bolt is being forced from the fixture the operator applies an additional axial force on the apparatus to compress the coil spring portion of the attachment device and further drive the bolt from the fixture. When the bolt can no longer be driven and remains in the fixture, the driving effort is stopped, the apparatus is removed from the bolt and a spacer rod is inserted in the bore of the alignment sleeve portion to extend the driving ability of the apparatus. This procedure can be repeated until the bolt is completely removed from the fixture. Spacer rods of various lengths can be used to completely remove the bolt from the fixture according to the steps of this method.

EXAMPLE

An application where this apparatus has been reduced to practice was in the removal of a bolt on the suspension system of a heavy truck trailer. A pair of bolts through mounting brackets 105 and a metal cylindrical hub 103 fixture that support the front and rear leaf springs from an equalizer bracket 106 on a dual tandem running gear of the trailer needed to be removed so that a spring could be replaced (see FIG. 3). At replacement time, the bolts are typically frozen with the metal hub due to corrosion and the like. The equalizer bracket 106 was further held by a rubber grommet 104 that supports the movement of the equalizer bracket 106 relative to the cylindrical hub 103 as the loaded trailer deflects the suspension system. The presence of the grommet makes the task more difficult by absorbing the impact loads of the air hammer. An alignment sleeve for this application was about 6 inches long with an outside diameter of about 1.25 inches. The inside cylindrical bore diameter was approximately 0.90 inch to remove the two ¾ inch diameter bolts. Each bolt without a nut initially extended about 1.25 inches from a steel plate of the fixture. The alignment sleeve aligned the bolt with the driving bit and the coil spring absorbed the shock of the driving force during removal of the bolt. The spring was compressed about one inch during the initial driving operation. A spacer rod was required during the removal operation to force the bolt totally from the fixture. The two bolts were removed and replaced in about 30 minutes. This same task has taken as long as four hours for the bolts to be removed without the attachment device, and three to three and a half hours is quite common.

While preferred embodiments of the invention have been described using specific terms, such description is for illustrative purposes only, and it is to be understood that changes and variations may be made without departing from the spirit or scope of the following claims.

What is claimed is:

1. An alignment and shock absorbing device in combination with an air hammer to remove a bolt from a fixture, said air hammer having a housing with a fixed collar and a reciprocating driving bit extendable through said collar from a retracted position to an extended position, said device comprising:

an alignment tube having first and second ends;

a tapered compressible coil spring having first and second ends, wherein said spring tapers from said first end to said second end, with said first end of said coil spring surrounding and being affixed to an outer wall of said collar, and said second end of said coil spring surrounding and being affixed to an outer wall of said alignment tube at said second end thereof, such that said coil spring is compressible over an interfacial space generally from the point of affixation to said collar and the point of affixation to said alignment tube, wherein said coil spring and said alignment tube form an unobstructed alignment sleeve free of structure, excluding said collar, but including said bit when in its retracted position; whereby when the bolt is positioned within said first end of said alignment tube with said first end urged against the fixture and the coil spring is compressed, said bit is guided in an unobstructed manner through said alignment sleeve and into engagement with said bolt, thereby driving said bolt from said fixture.

2. The device set forth in claim 1, wherein said coil spring is affixed to said alignment tube by providing a locking groove in said outer wall of said alignment tube which receives an end coil of said coil spring so that said coil spring remains fixed with respect to the alignment tube and symmetrical with respect to an axis of said device.

3. The device set forth in claim 1, wherein said coil spring has a stiffness value in the range of about 50 pounds per inch to about 100 pounds per inch and said pace between adjacent coils has a value in a range of about 0.5 inch to about 0.75 inch when said spring is not compressed.

4. The device set forth in claim 1, wherein a diameter of paid cylindrical bore within said alignment tube provides a clear space of at least 0.10 inch between it and said driving bit to allow freedom of movement between the alignment tube and the driving bit without lubrication.

5. The device set forth in claim 4, wherein said alignment tube has a length of about 6 inches, an outside diameter of about 1.25 inches and an interior diameter of about 0.90 inch to drive a bolt having a ¾ inch diameter.

* * * * *